United States Patent [19]

Wichman

[11] Patent Number: 4,986,016

[45] Date of Patent: Jan. 22, 1991

[54] FOLDING DISPLAY FRAME WITH OFFSET HUB CONFIGURATION

[76] Inventor: William J. Wichman, 702 Brownsage Dr., Glendora, Calif. 91740

[21] Appl. No.: 431,469

[22] Filed: Nov. 3, 1989

Related U.S. Application Data

[63] Continuation-in-part of Ser. No. 940,019, Dec. 10, 1986.

[51] Int. Cl.[5] ..... G09F 15/00

[52] U.S. Cl. ..... 40/610; 52/109; 52/646; 403/176

[58] Field of Search ..... 40/610, 606, 611; 52/645, 648, 646, 650, 109, 655, 80, 81, 109; 135/102, 103, 109; 403/169, 174, 172, 171, 173, 176, 54–56; 211/182; 248/166

[56] References Cited

U.S. PATENT DOCUMENTS

| | | | |
|---|---|---|---|
| 2,659,618 | 11/1953 | Capra | 403/176 |
| 3,381,923 | 5/1968 | Berry | 248/166 |
| 3,507,526 | 4/1970 | Packman et al. | 403/173 |
| 3,563,580 | 2/1971 | Black | 52/648 X |
| 3,710,806 | 1/1973 | Kelly et al. | 135/4 R |
| 3,810,482 | 5/1974 | Beavers | 135/4 R |
| 3,830,031 | 8/1974 | Soisson | 52/109 X |
| 3,888,056 | 6/1975 | Kelly et al. | 52/109 |
| 3,914,063 | 10/1975 | Papayoti | 403/176 X |
| 4,111,574 | 9/1978 | Runyon | 403/54 |
| 4,241,746 | 12/1980 | Rothe | 52/80 X |
| 4,393,887 | 7/1983 | Orobin | 52/645 X |
| 4,512,097 | 4/1985 | Ziegler | 40/611 |
| 4,809,471 | 3/1989 | Wichman et al. | 52/109 |

FOREIGN PATENT DOCUMENTS

| | | | |
|---|---|---|---|
| 711257 | 1/1980 | U.S.S.R. | 403/171 |

*Primary Examiner*—Kenneth J. Dorner
*Assistant Examiner*—J. Hakomaki
*Attorney, Agent, or Firm*—Christie, Parker & Hale

[57] ABSTRACT

A collapsible framework is constructed of rods pivotally joined at their ends to hubs to form a self-standing unit when expanded and to fold into a small set of nearly parallel rods when folded. In one embodiment in which the expanded frame forms an array of cubicles, the hubs are designed to pivotally join the ends of four rods, with the plane defined by the pivot axes of one pair of opposing rods being offset from the plane defined by the pivot axes of the other pair of opposed rods attached to the same hub. One pair of rods attached to each hub can pivot on one of several pivot points on extended hub flanges to thereby provide expanded frameworks of various arcuate configurations. A stab-connection latch locks two hubs together and secures the framework in the expanded position. Folding channel bars are attached to knobs on vertically aligned hubs by keyslots. The keyslots of one channel bar are of progressively shorter length going from the topmost to the bottommost of the vertically aligned hubs to which the bar is attached. The folding channel bars have adjustable friction-type hinge pins for controllably folding sections of the channel bars.

34 Claims, 13 Drawing Sheets

FOLDING DISPLAY FRAME WITH OFFSET HUB CONFIGURATION

CROSS-REFERENCE

This is a continuation-in-part of my application Ser. No. 06/940,019, filed Dec. 10, 1986, which is incorporated herein by this reference.

FIELD OF THE INVENTION

This invention relates to folding display frames, and more particularly, to a hub design for interconnecting pivotally joined rods into a folding frame.

BACKGROUND OF THE INVENTION

Folding display frames are commonly used at trade shows for holding display panels assembled into a temporary display stand. Photomural displays and other graphics, projection screens, product display shelves, and the like are commonly mounted on the portable display stands.

Folding display frames typically comprise a number of rigid frame members pivotally connected together at their ends in a collapsible and portable form. The framework, in its expanded or open state, commonly consists of a grid of horizontal and vertical rod members forming an array of cubicles. The frame is carried to the exhibition hall in its collapsed form and is then erected to form the rigid structural framework for the display stand. Display panels, which are mounted to the display frame, and other structural members of the supporting frame also are carried to the trade show in a compact form. The entire folding display system is then assembled into the finished display unit. When the trade show is completed, the display frame is collapsed and the display system is carried away in its portable form.

In a typical three-dimensional framework, a plurality of rod members are pivotally connected together to permit collapsing of the framework into a compact form in which the rod members lie substantially parallel to each other. Except where the framework is assembled in a substantially permanent structure, the rod members are pivotally joined at their ends to some type of hub, so that the rods can be rotated relative to each other as the framework is adjusted between its open, expanded configuration and its closed, compact storage configuration. Examples of such prior art folding frameworks are found in U.S. Pat. No. 4,471,548, Goudie; U.S. Pat. No. 4,479,340, Alphonse, et al.; U.S. Pat. No. 4,512,097, Zeigler; U.S. Pat. No. 4,580,375, Nodskov, et al.; and U.S. Pat. No. 4,276,726, Derus.

One of the objectives in designing folding display frames is to make the structure light in weight and compact in its folded form to enhance ease of transportation and storage when the framework is not in use. At the same time, the framework, when fully expanded into its useful configuration, must be strong and fairly rigid. The framework not only must be strong enough to give adequate support to the display panels and the items mounted on them, but it must also withstand abuse, particularly when being constantly folded and unfolded.

Large diameter thin-walled metal tubes normally provide maximum strength-to-weight ratios. However, the hubs to which the tubes are pivotally joined must be made light and compact to reduce the space required by the hubs when they are brought together in the collapsed configuration of the framework. In the past, attempts to utilize small hubs and thin solid rods have resulted in a relatively fragile structure, whereas use of larger diameter tubular rods has resulted in bulkier and heavier hubs.

A commonly used display frame configuration is one in which the upright frame has a curved configuration, i.e., the frame is arcuate in the top plan view shape of the expanded frame. Such a configuration tends to be more stable than an expanded display frame in a flat form. Therefore, it is desirable for the portable display frame to be quickly and easily assembled into a stabilized curved configuration and then be easily collapsed from this configuration without difficulty.

Display booth spaces rented in exhibition halls are generally of standard sizes; a standard trade show booth is ten feet wide, for example. As a result, the folding display frames are commonly assembled into an expanded configuration which stays within the standard ten-foot-wide space. However, the designs of prior art portable display frames tend to limit the configurations of the display stands which are able to fit within the standard booth space.

Thus, there is a need for a simple, lightweight, strong and rigid folding display frame which can be quickly and easily unfolded and assembled into an expanded configuration used in supporting various types of display stands at trade shows. The display frame also should be easily expanded into the desired, curved, stabilized configuration normally used in trade show display stands. The frame also should be quickly and easily folded into its compact configuration when not in use. The particular configuration in which the display frame is used should not interfere with ease of folding the framework into its compact form. The configuration of the display frame also should not require a large volume or weigh too much when the frame is folded, since these folding frameworks must be conveniently transported to and from the exhibition hall.

SUMMARY OF THE INVENTION

This invention is directed to an improved folding framework incorporating a unique hub design that permits large-diameter, thin-walled tubes to be pivotally connected in a strong, rigid joint. At the same time, the hub is very compact and light in weight. In addition to producing a framework which is strong and rigid in its expanded form, the framework easily unfolds and folds into a lightweight, compact form. An added advantage of the present hub design is that it allows rod members of unequal length to be incorporated into the framework's array so that the height of the array may be, for example, less than the width while still permitting the structure to be folded effectively.

Briefly, one embodiment of the framework incorporating features of the present invention, in its expanded or open state, consists of a grid of horizontal and vertical rod members forming an array of cubicles, each cubicle having a top, bottom and two side frame sections. Each frame section consists of two rods or tubes pivotally joined to each other midway between their ends. The rods terminate at each end in pivotally attached hubs. Adjacent cubicles in the array share common rods and hubs. In the framework's collapsed or closed state, the rods of each frame section are rotated with respect to each other approximately 180° so that the opposite ends are brought into proximity. The hubs are then closely packed in two groups at opposite ends of the substantially parallel rods. This configuration allows the framework to be easily expanded into its open configuration and easily collapsed into its compact configuration.

Each hub is uniquely formed with a base and integrally formed flanges projecting from the base, the flanges being mutually perpendicular to each other. A tubular rod is pivotally attached at each end to a hub flange. The pivot axes of tubes secured to one pair of diametrically opposite flanges are parallel and lie in a first common plane, and the pivot axes of the tubes secured to the other pair of diametrically opposite flanges also are parallel, but lie in a second common plane that is parallel to, but offset from the first plane. This provides a "high" and "low" hub configuration of sufficiently compact size that the frame members can be folded into proximity with the hubs moved together as close as possible in a two dimensional array, while the folding rods avoid interference during rotation to allow the framework to be folded into an extremely compact size. The "high" and "low" hub configuration also allows folding into this compact size while the frame is constructed from tubular rods of large-diameter, thin-walled construction that provide maximum strength-to-weight ratios. Therefore, the hub construction allows folding into the contact size without sacrificing the rigidity and strength of the overall framework.

As a further advantage provided by the "high" and "low" hub configuration, the folding display frame can be expanded into a variety of predetermined configurations. In one embodiment, a combination of rod members of different lengths attached to different short or long flanges of the hub makes it possible to form either a square lattice construction or a rectangular lattice construction. In a further embodiment, hub length can be extended to provide different points of pivotal attachment of the rod members to the hub, so that different combinations of rod member lengths and pivot points on the hub can produce a variety of display frame configurations. One advantage of this embodiment is that various display stand configurations can be produced while the finished display stand still fits within the confines of the standard ten-foot-wide display booth size.

These and other aspects of the invention will be more fully understood by referring to the following detailed description and the accompanying drawings.

DETAILED DESCRIPTION

Figure 1:
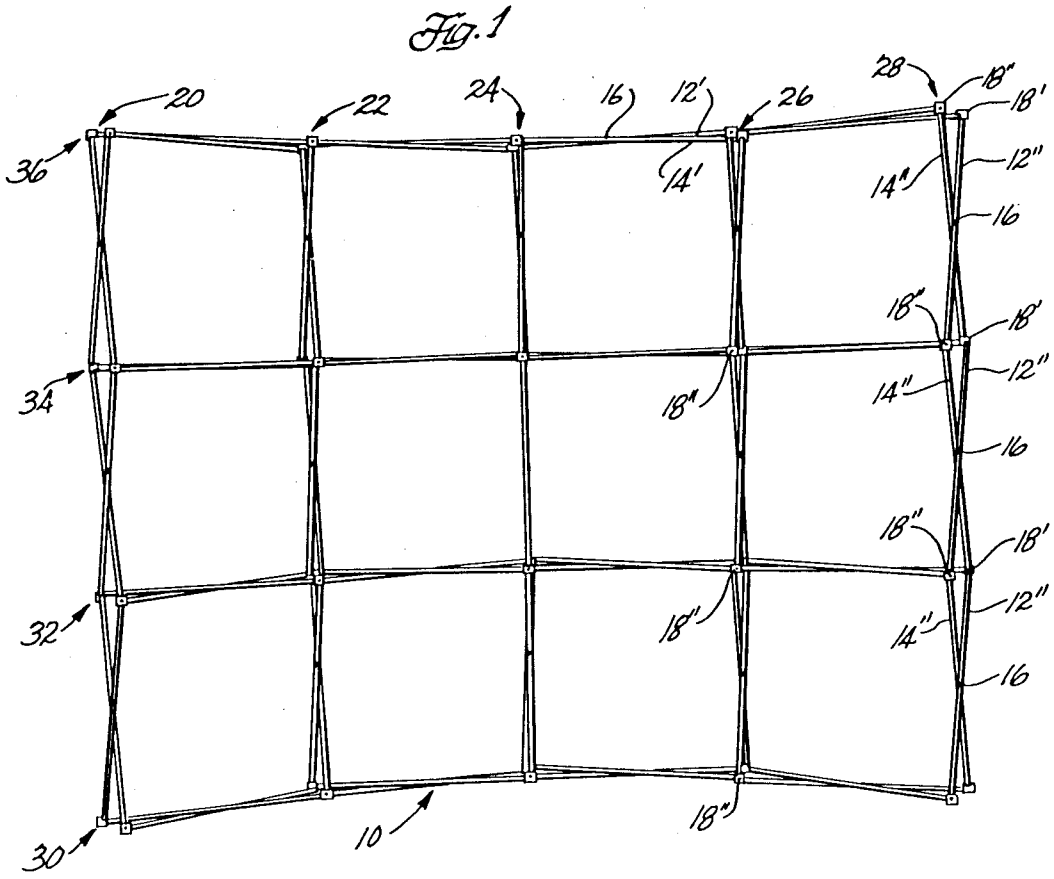
FIG. 1 is an elevational view of a display frame in an expanded position.

Referring to FIG. 1, the numeral 10 indicates generally a folding framework shown in its open or expanded position. The framework is constructed from multiple pairs of rods or frame members in the form of thin-walled metal tubes, such as indicated at 12 and 14. The rods in each pair are pivotally joined together by a hinge pin 16. The hinge pins 16 are located between the ends of the rods, allowing the rods to swivel with respect to each other in scissors-like fashion. These rod pairs are joined to form a grid-like framework, with the multiple pairs of rods being arranged in vertical columns and horizontal rows. The ends of the rods are joined by a plurality of identical hubs 18.

Figure 2:
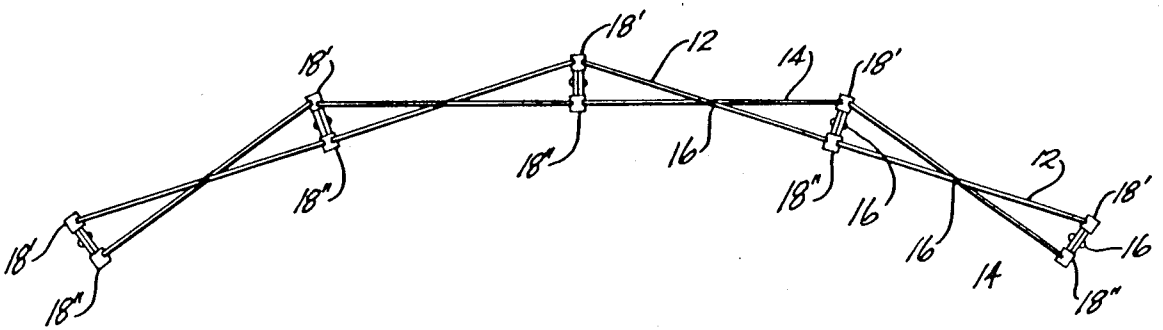
FIG. 2 is a top plan view of the expanded frame.

As best shown in FIGS. 1 and 2, the framework in the expanded or open position comprises a plurality of vertical columns, five of which are indicated respectively at 20, 22, 24, 26 and 28. These are joined by a plurality of horizontal rows, four of which are indicated at 30, 32, 34 and 36. Each of the rows, as best shown in the top view of FIG. 2, is made up of pairs of rods 12 and 14 in which the hinge pin pivot connection 16 is located slightly off the center or mid-position between the ends of its respective rods. Since all horizontal rods are of equal length, this causes the four pairs of rods joined in each row to assume a slightly arcuate shape. This shape gives more stability to the frame when resting on the floor or some other supporting surface.

The rod and hub configuration allow the folding display frame to move between the open expanded position and a compact closed form for storage. In the open expanded position, the framework forms a three-dimensional array of framelike compartments of polygon form which, in the illustrated embodiment, are formed as cubicles with respective hubs at the corners of the cubicles. The respective ends of each rod are pivotally joined to corresponding ones of the hub and each hub has a plurality of the rods pivotally joined to it. The pivotal connection of each rod to a hub provides rotation of the rod relative to the hub about a corresponding single axis of revolution. The rods connected to any one hub are rotatable about the single axis of revolution from a closed position in which all rods are substantially parallel to each other to an open position in which the rods radiate outwardly from each other. Each hub has a base plate with fixed flanges projecting from it for pivotally supporting a first pair of rods secured to a corresponding first pair of flanges on opposite sides of the central axis of the hub and a second pair of rods pivotally connected to a corresponding second pair of flanges on opposite sides of the central axis of the hub, in which the second flanges extend substantially perpendicularly to the first flanges in the configuration in which the compartments of the frame are formed as cubicles. The pair of first flanges have corresponding fixed first bearing surfaces lying substantially on a first axis passing essentially through the central axis of the hub. The pair of second flanges have corresponding fixed second bearing surfaces lying substantially on a second axis passing essentially through the central axis of the hub and extending substantially perpendicularly to the first axis, in the configuration in which the compartments are formed as cubicles. The ends of the first rods, pivotally secured to the first bearing surfaces, are rotatable thereon about spaced apart fixed axes of revolution extending substantially parallel to each other and lying substantially in a first plane. The ends of the second rods, pivotally secured to the second bearing surfaces, are rotatable thereon about spaced apart fixed axes of revolution extending substantially parallel to each other and lying substantially in a second plane which is spaced outwardly from the base plate by an offset distance greater than the first plane and which lies substantially parallel to the first plane. This configuration of expandable and contracting cubicles in the framework provides a number of improvements in folding display frames described below, and although the invention is described with respect to the framework being formed with an array of cubicles, other geometric forms also are possible without departing from the scope of the invention.

The framework is locked in the expanded position shown in FIGS. 1 and 2 by a suitable latch mechanism which anchors one or more pairs of adjacent hubs 18' and 18" together. A preferred latch for this purpose is shown in detail in FIG. 6. One hub of the pair, such as indicated at 18', has a latch rod 40 which projects toward the adjacent hub 18" of the pair. As the framework is expanded to its open position by moving the pairs of hubs 18' and 18" toward each other, the latch rod 40 engages a latch receptacle which is rigidly secured to the hub 18". The latch rod 40 enters a hole or bore 44 in the end of the latch receptacle 42 where the tapered end 46 of the rod 40 engages a spring-loaded latch pawl 48. As the latch rod is fully inserted into the bore 44, the latch rod pawl engages a notch 50 in the rod, securely locking the rod 40 in position in position in the latch receptacle 42. The pawl, which is pivotally supported on the receptacle by a pin 52 can be disengaged from the notch 50 to release the latch by pushing down on the opposite end 54 of the latch pawl 48. The pawl is urged into engagement with the notch 50 by a suitable spring 51. The latch mechanism shown in FIG. 6 need only be provided for one pair of hubs, preferably near the center of the framework grid. If greater rigidity is required, additional pairs of hubs can be provided with such a latch mechanism.

Figure 9:
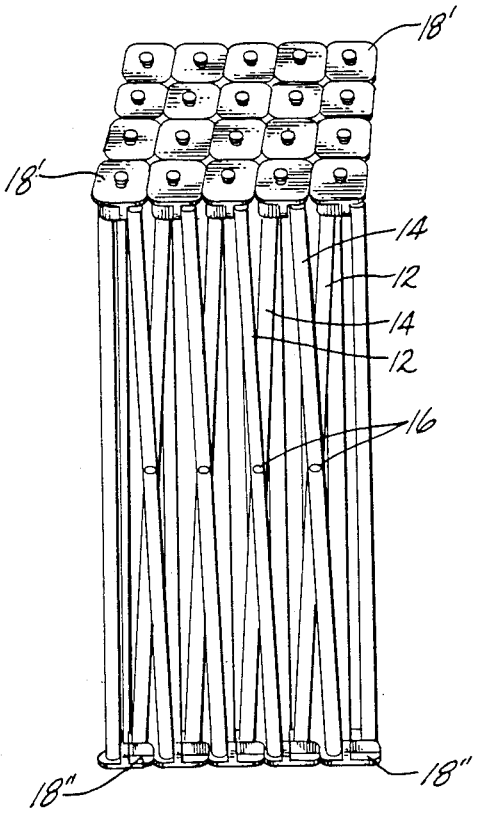
FIG. 9 is a perspective view showing the frame in the folded or collapsed position.

With the latch mechanism released, the entire framework can be collapsed or folded into the storage condition, as shown in FIG. 9. In this position the two rods 12 and 14 in each pair of such rods are rotated relative to each other about the connecting pivot 16, allowing each respective pair of hubs 18' and 18" to be moved apart until the rods 12 rotate almost 180 degrees relative to the other rods 14 of each pair. In the fully folded position, all the hubs 18' move into side-by-side engagement with each other, and all the hubs 18" also move into engagement with each other. In this way, the hubs are nested in two groups, each group occupying an area which is limited by the size of the hubs.

In order to achieve nesting in the minimum space and to make the folded framework as compact as possible, a unique hub is provided which allows the hub to be substantially reduced in size without sacrificing rigidity and strength of the framework. At the same time, the hub design of the present invention provides for ease of assembly in pivotally attaching the rods to the hubs. Details of the hub design are shown more clearly in FIGS. 3–5.

Figure 5:
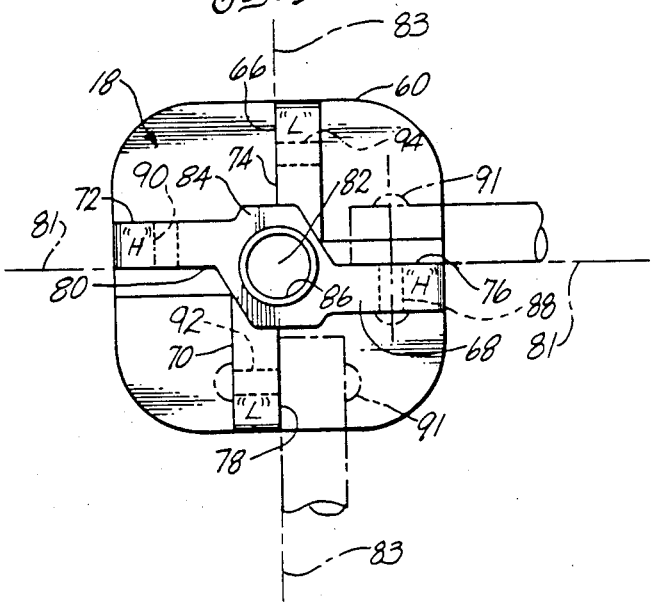
FIG. 5 is a front elevational view taken on line 5—5 of FIG. 3.

Referring to these figures, the hub 18 is preferably molded of a suitable plastic material, but it can be die-cast or otherwise formed of light weight metal. The hub is formed with a base plate 60 which is generally square in outline with the corners rounded as shown in FIG. 5 The base plate has a flat outer surface 62 from which projects a knob or flanged pin 64. The knob 64 is used to mount various auxiliary devices to the framework.

An inner surface 65 of the hub base plate 60 has four flanges or hinge plates 66, 68, 70 and 72 projecting perpendicularly from it. These flanges are offset from each other, as viewed in FIG. 5, so that each flange provides a flat surface, indicated respectively at 74, 76, 78 and 80. These bearing surfaces lie in two mutually perpendicular planes. The bearing surfaces 76 and 80 lie in a first common plane 81 (see FIG. 5) passing through the central axis 82 of the hub, while the surfaces 74 and 78 lie in a second common plane 83 (see FIG. 5) also passing through the central axis 82 of the hub, perpendicular to the first plane 81. The flanges 68 and 72 project away from the base plate 60 a distance substantially twice that of the flanges 66 and 70. The outer projecting ends of the flanges 68 and 72, which are hereinafter referred to as "high" flanges, intersect in an enlarged central portion 84 having an opening or hole 86 into which the latch rod 40 or latch receptacle 42 may be press-fitted or otherwise secured. (The "high" flanges are shown at "H" in FIG. 5.) The "high" flanges 68 and 72 have holes 88 and 90 adapted to receive a separate pivot pin or rivet 91 which pivotally secures the end of a corresponding tubular rod to each flange. The axes of the holes 88 and 90 are parallel to each other and lie in a common plane 91 (see FIG. 4).

Similarly, the flanges 66 and 70, referred to as the "low" flanges of the hub, have holes 92 and 94 adapted to receive the hinge pins or rivets 91 associated with additional tubular rods. (The "low" flanges are shown at "L" in FIG. 5.) The axes of the holes 92 and 94 in the "low" flanges are parallel to each other and lie in a common plane 95 (see FIG. 4). The plane of the holes 92 and 94 in the "low" flanges is offset by a distance "A" from the plane of the holes 88 and 90 in the "high" flanges.

The backsides of the "high" flanges 68 and 72 are undercut, as indicated at 96 and 98, respectively, to provide clearance for the ends of the rods pivotally attached to the "low" flanges when the rods are rotated about the axes of the holes 92 and 94.

Figure 6:
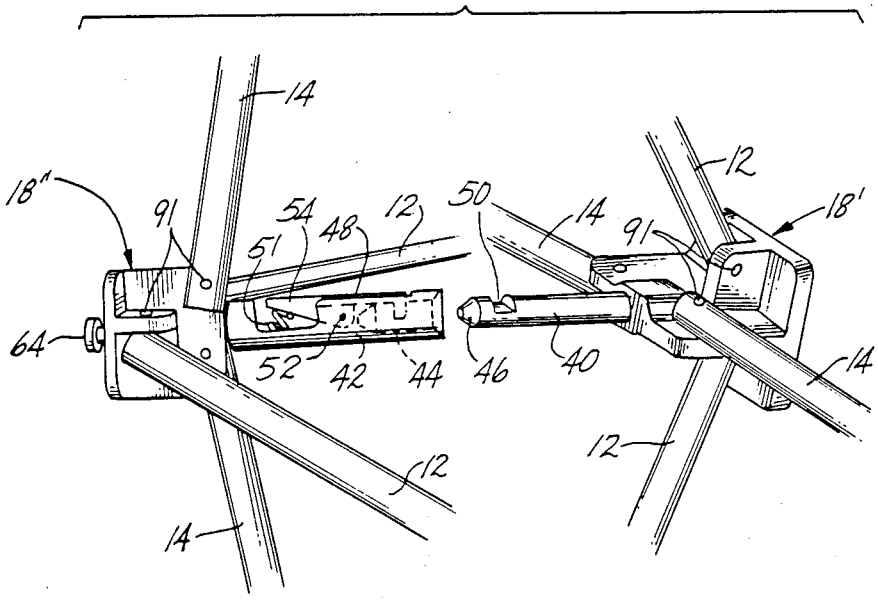
FIG. 6 is a partial view, in perspective, showing a the frame latching mechanism.

As shown best in FIG. 6, the "high" and "low" flange arrangement of each hub, as described above, allows for the ends of four relatively large-diameter tubular rods to be pivotally attached to each hub by the rivets 91. The offset "A" allows ready access to all the rivets 91 of each hub by suitable riveting equipment. Also, the flange configuration allows the outer perimeter of the base plate 60 to be made approximately equal to twice the diameter of the tubular rods, thus permitting the hubs to be made extremely compact and to nest against each other in two groups in the folded position of the framework, as illustrated in FIG. 9.

Figure 7:
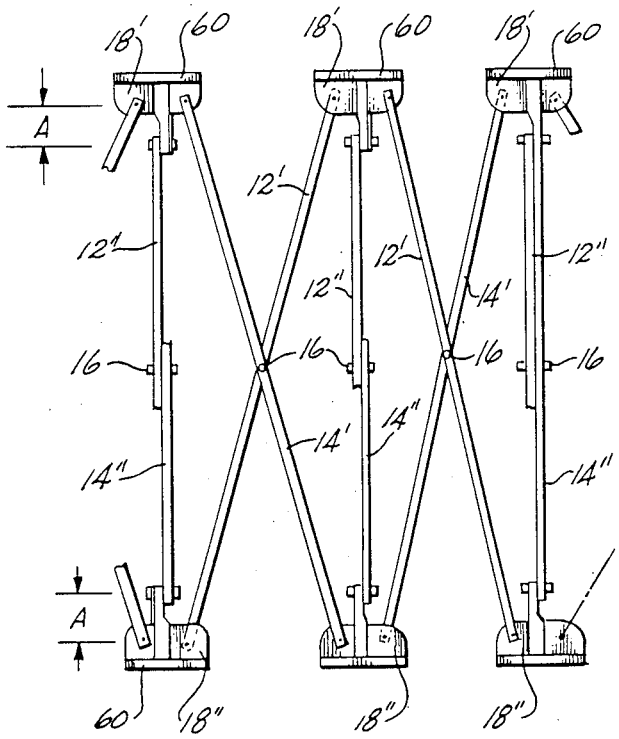
FIG. 7 is a detailed partial view of the frame in a nearly collapsed position.

Another advantage of the "high" and "low" flange arrangement of the hubs is that the rods in the horizontal rows can have a different length from the rods in the vertical columns, while still permitting the hubs to nest in two coplanar groups when the framework is in its folded position. This feature is best understood by reference to FIG. 7, which shows a portion of the framework in a substantially folded position. As the framework is expanded into its open position, by moving the hubs 18' toward the hubs 18", the pair of rods 12' and 14' rotate into the horizontal rows as shown in FIG. 1, while the rods 12" and 14" rotate into the vertical columns of the framework. Thus, the spacing between the hubs in the horizontal rows is determined by the length of the rods 12' and 14', while the distance between the hubs in the vertical columns is determined by the length of the rods 12" and 14". If, as shown in FIG. 7, all of the horizontal rods 12' and 14' are pivotally joined to the "low" flanges of the hubs 18, and all the vertical rods 12" and 14" are pivotally connected to the "high" flanges of the hub 18, it becomes necessary for the vertical rods to be made shorter in length than the horizontal rods in order for the hubs in each of the two folded groups (see FIG. 9) to be coplanar. In fact, as shown in FIG. 7, the rods 12" and 14" are shorter, by a distance equal to 2A (twice the offset A), than the horizontal rods 12' and 14'. As a result, when the framework is expanded to the open position, the openings or cubicles are not square but are rectangular, with the vertical dimension of each cubicle being smaller than the horizontal dimension by a distance substantially equal to 2A.

Figure 8:
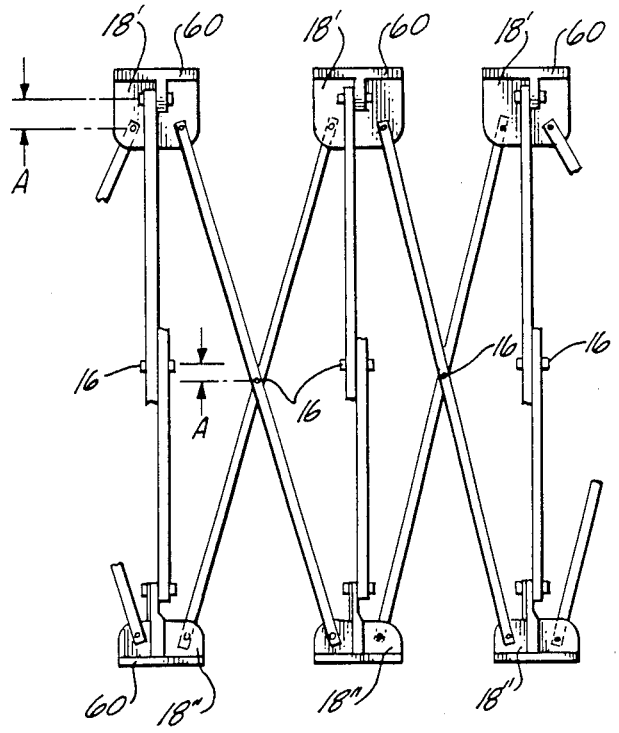
FIG. 8 is a detailed partial view similar to FIG. 7 but showing an alternate construction.

Thus, the "high" and "low" flange arrangement of the hubs allows the designer to modify the width-to-height ratio of the erected or expanded framework. It should be noted that if it is desired to construct the framework with all of the rods being of identical length, this can be accomplished merely by rotating the hubs 18' through an angle of 90° relative to the hubs 18". This causes the "high" flange of the hubs 18' to be aligned with a "low" flange of the hubs 18" so that every rod is pivotally joined at one end to a "low" flange and the other end is pivotally joined to a "high" flange. This alternative arrangement is shown in FIG. 8.

Thus, owing to the offset hub configuration, it will be recognized that the improved display framework of this invention can be made very compact and light in weight. In addition, the folding framework folds into its compact size while maintaining rigidity and strength of the overall framework. In one embodiment, the folding framework uses 1-⅜ inch hubs with tubular rods of 7/16 inch outside diameter and 0.05 inch wall thickness, and yet the framework can fold up into the compact size shown in FIG. 9 in which the hubs are all nested together adjacent to one another in a small package. By contrast, other frameworks that fold out to the same size but which use a different hub configuration cannot fold into the same compact size with tubular rods of the same size and strength as the present framework. These prior art devices have typically comprised tubes of 5/16 inch outside diameter and 0.13 inch wall thickness, so that these much thinner rods are able to flex during folding in order to fold up into a somewhat compact (but still larger) size. These thinner, more flexible rods are more prone to breaking and greatly sacrifice the needed strength and rigidity of the overall framework.

Figure 10:
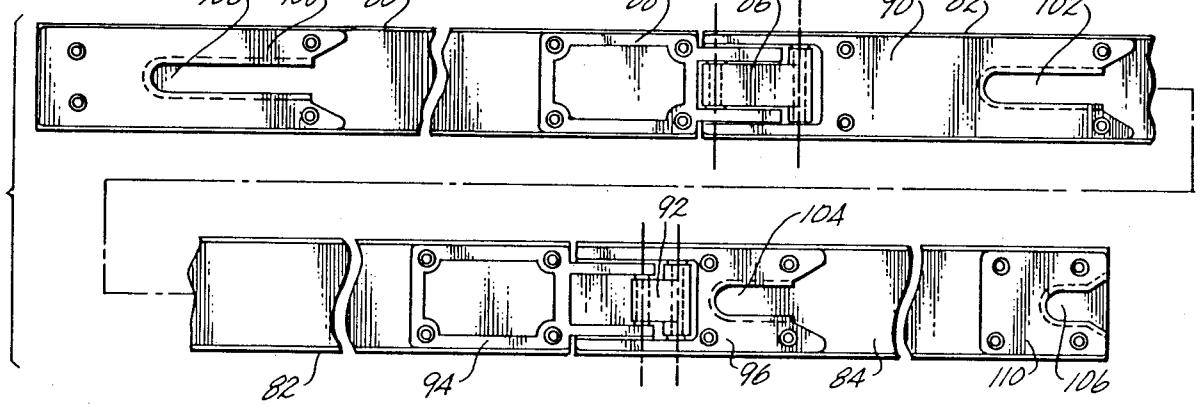
FIG. 10 is a detailed plan view of a folding channel bar.
Figure 11:
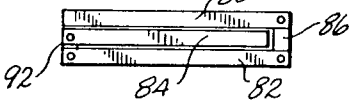
FIG. 11 shows the channel bar in its folded condition.

In order to attach panels of heavy fabric or other materials to the face of the framework after it is erected, it is desirable to attach vertical channel bars to the framework along each of the vertical rows of rods. In the past, these channel bars have been made up in individual sections corresponding to the height of each cubicle and the frame. The one feature of the present invention is an improved channel bar in which the sections are hinged together so that the channel bar can be attached as a unit or folded for storage. The channel bar is shown in FIGS. 10 and 11 and includes three sections 80, 82 and 84. The sections 80 and 82 of the channel bar are joined by a link 86 pivotally attached to a hinged member 88 secured to the bar section 80 and by a hinged member 90 secured to one end of the bar section 82. Similarly, the channel bar section 82 is connected to the channel bar section 84 by a hinge including a link 92 pivotally attached to a hinged plate 94 secured to the channel bar section 82 and by a hinged plate 96 secured to the channel bar section 84. The link 86 is longer than the link 92, allowing the channel bar section 82 to be folded between the channel bar sections 82 and 80 in the manner shown in FIG. 11.

The three sections of the channel bar are attached to the front of the framework by four keyslots indicated at 100, 102, 104 and 106. The keyslots 102 and 104 are formed in the hinged members 90 and 96, respectively, while the keyslots 100 and 106 are formed in blocks 108 and 110 secured to the respective ends of the channel bar. The keyslots are open at one end and are arranged to engage knobs 64 on the front of the hubs of the framework. To simplify the assembly of the channel bar to the framework, the keyslots are made progressively shorter from the top to the bottom of the channel bar as the keyslot 100 is longer than the slot 102, the keyslot 102 is longer than the slot 104, and the keyslot 104 is longer than the slot 106. This simplifies the assembly of the framework and channel bars since the keyslots can be engaged with one knob at a time starting at the top.

Thus, with the keyslot 100 at the top of the channel bar engaged with the top knob of a column, the channel bar assembly can be lifted sufficiently to engage the keyslot 102 at the next lower knob without disengaging the longer keyslot 100. Similarly, the keyslot 104 can be engaged with a knob without disengaging the slot 102. When so attached to the frame, the channel bars form a continuous vertical strip to which panels can be attached for covering the framework with a smooth, continuous display surface.

A further embodiment of a hinged channel bar is described in detail below and shown in FIGS. 20 through 22.

Figure 12:
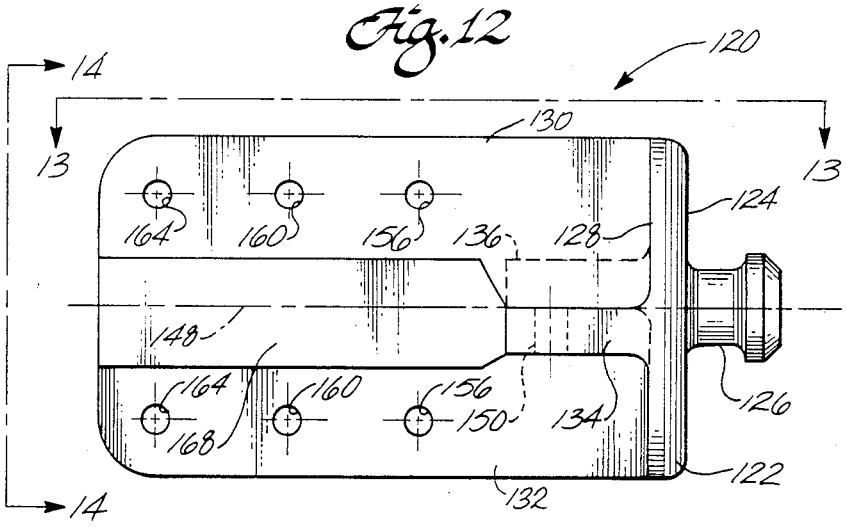
FIG. 12 is an elevational view illustrating an alternative configuration of the frame hub.
Figure 13:
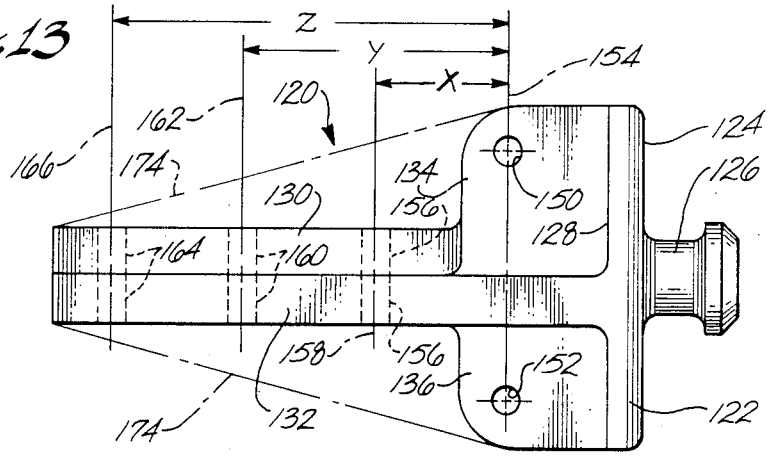
FIG. 13 is an elevational view taken in line 13—13 of FIG. 12.
Figure 14:
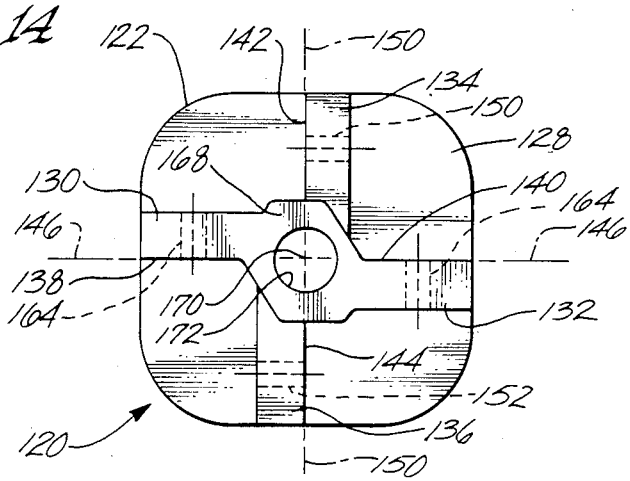
FIG. 14 is an end elevational view taken on line 14—14 of FIG. 12.

FIGS. 12 through 14 show an alternative "high" and "low" flange configuration of the hub which provides improved flexibility in frame design. In the illustrated embodiment, an alternative hub 120 is molded from a suitable hard plastic material. The hub includes a rectangular (preferably square shaped) base plate 122 having a flat outer surface 124. A knob or flanged pin 126 projects from the flat outer surface 124. A set of four flanges or hinge plates project perpendicularly from an inner surface 128 of the base plate 122. These flanges include a pair of long flanges 130 and 132 which, during use, will extend generally in a horizontal plane, and a pair of short flanges 134 and 136 which, during use, will extend in a generally vertical plane. These flanges are offset from each other, as viewed in FIG. 14, so that each flange provides a flat bearing surface, indicated respectively at 138, 140, 142, and 144. These bearing surfaces lie in two mutually perpendicular planes. The bearing surfaces 138 and 140 of the long flanges lie in a first common plane 146 (see FIG. 14) passing through the central axis 148 of the hub, while the bearing surfaces 142 and 144 of the short flanges lie in a second common plane 150 (see FIG. 5) also passing through the central axis 148 of the hub, but perpendicular to the first plane 146. The long flanges 130 and 132 project away from the base plate 122 by a distance substantially longer than the distance by which the shorter flanges 134 and 136 project from the base plate 128. Although the length of the longer flanges can vary depending upon the desired configuration of the finished open framework, in the illustrated embodiment the long flanges 130 and 132 project away from the base plate by a distance substantially four times longer than the short flanges 134 and 136. This extended length of the long flanges provides a means for attaching the ends of the tubular rods to a selected one of several pivot points spaced apart along the long flanges. In the illustrated embodiment, the short flanges 134 and 136 are the same length as the "low" flanges of the hubs shown in FIGS. 3 through 5. The short flanges 134 and 136 also have holes 150 and 152, respectively, which are aligned in a common plane 154 substantially parallel to the face of the base plate 122. As with the framework described previously, these holes are adapted to receive separate pivot pins or rivets for securing the ends of tubular rods to the hub flanges. As described in more detail below, the short flanges are used for securing the ends of the vertical rods in a folding display frame.

In the illustrated embodiment, the long flanges 130 and 132 have three pairs of holes for use in attaching tubular rods to a selected one of three pivot points on the long flanges. This arrangement of pivot points on the long flanges is one of several possible arrangements. Referring to the illustration, a first pair of holes 156 are spaced outwardly from the holes in the short flanges by a distance "X." The first pair of holes are aligned on a common plane 158 parallel to the plane 154 on which the holes in the short flanges are aligned. The long flanges further include a second pair of holes 160 lying in a common plane 162 parallel to the plane 158 and spaced from the plane 154 by a distance "2Y"; and a third pair of holes 164 lying in a common plane 166 parallel to planes 158 and 162 and spaced from the plane 154 by a distance "3Z." These pairs of holes are adapted to receive separate pivot pins or rivets for securing the ends of a pair of tubular rods to a selected pair of either the first holes, the second holes, or the third holes. In the description to follow it will be seen that the locations of the holes in the long flanges used for securing the ends of the horizontal tubular rods can be selected to control various framework designs.

The arrangement of the holes in the long flanges 130 and 132 can take various forms. The distances between holes, i.e., the dimensions "X", "Y", and "Z" can be any selected distance, the dimensions being selected to control the final configuration of the expanded framework. In addition, the holes in the long flanges need not be arranged in pairs, aligned in common planes, as shown in FIGS. 12 and 13. The spacings "X", "Y", and "Z" between holes 156, 160 and 164 on the long flange 130 can be different from the spacings between the holes on the other long flange 132. Different spacings among pivot points on the left and right sides of the same hub can be used to produce expanded frames of different curved configurations, as shown below.

As shown best in FIG. 14, the modified hub also includes an enlarged central region 168 projecting from the base plate, extending the length of the long flanges, and aligned on a main central axis 170 of the hub. The inner ends of the short flanges 134 and 136 are integrally molded to this enlarged central region, and the short flanges above and below the central region are offset from each other, i.e., to one side and the other of the central region. As with the hub described in FIGS. 3 through 5, this offset provides added space to one side or the other of the short flanges for accommodating the ends of the tubular rods pivotally affixed to each of these flanges.

Similarly, the inner ends of the long flanges 130 and 132 are integrally molded to the long central region 168 along its entire length, and the long flanges on the left and right sides of the central region are offset to one side and the other of the central region. This offset again provides added space to one side or the other of the long flanges for accommodating the ends of the tubular rods pivotally affixed to a selected one of the three pairs of holes on the long flanges. The enlarged central region 168 also includes an opening or hole 172 into which a latch rod or latch receptacle may be press fitted or otherwise secured in a manner similar to that described for the previous folding display frame.

Although the modified hub in the illustration uses three spaced apart holes on each side of the hub for attaching the horizontal tubular rods to one of three different locations on each side of the long hub flanges, other embodiments using additional attachment holes or other hole patterns also can be used. In addition, gussets (illustrated in phantom lines 174) also can be added to the long flanges for additional strength, if necessary.

Figure 15:
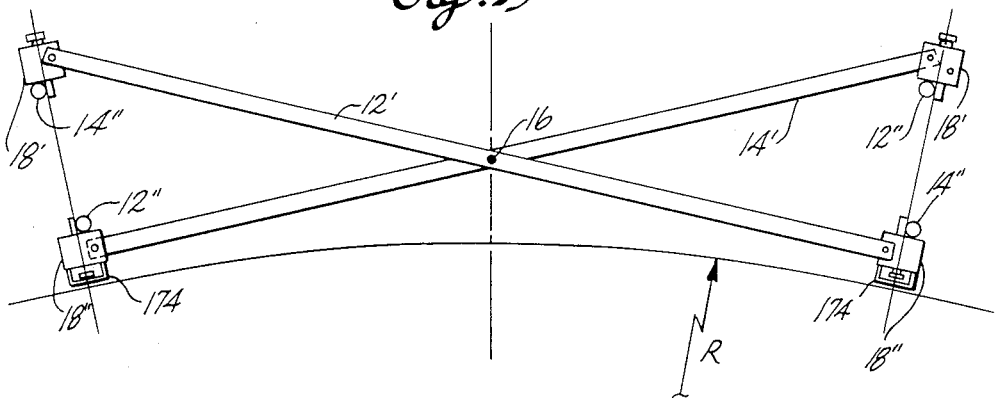
FIG. 15 is a semi-schematic plan view illustrating a standard configuration of an expanded frame using the hub design illustrated in FIGS. 3 through 5.

At the present time, portable displays for trade shows are available in approximately the same shape for a standard display booth which is ten feet wide. The standard display frame typically forms an arc having a radius about six feet (68 to 74 inches) long. FIG. 15 is a top plan view illustrating a display frame section of FIGS. 1 through 9 in its expanded form in use in a standard display booth area. In this illustration the display frame includes a pair of front hubs 18″ and a pair of rear hubs 18′ joined by a pair of rods 12′ and 14′ in the horizontal plane. These rods form a horizontal "X" frame as described previously. On the sides of each cubicle the front and rear hubs are joined by a pair of rods 12″ and 14″ in the horizontal plane, also forming a vertical "X" frame for the side of each cubicle. The hubs 18″ which are spaced vertically along the front of the display frame provide a means for attaching vertical support members 176 for the display panels. The front of the display frame section shown in FIG. 15 forms a radius "R" of about 68 inches. By interconnecting four of these frame sections side-by-side, as illustrated in FIG. 2, a portable display frame with panels on a uniform curved pattern is formed, and the resulting curved display stand fits within the standard ten-foot wide booth area.

The present invention is based on a recognition that the "high" and "low" hub flange configuration of this invention makes it possible to produce portable folding display frames of different configurations, in addition to the standard curved configuration of FIG. 15. In one example the display frame sections can be arranged to produce a continuous display frame with changing radius from panel to adjacent panel while keeping the height of the display frame constant; or the display frame panels can be made narrower so that special flatter shapes can fit within the standard ten-foot wide booth space while keeping the height of the frame the same.

Figure 3:
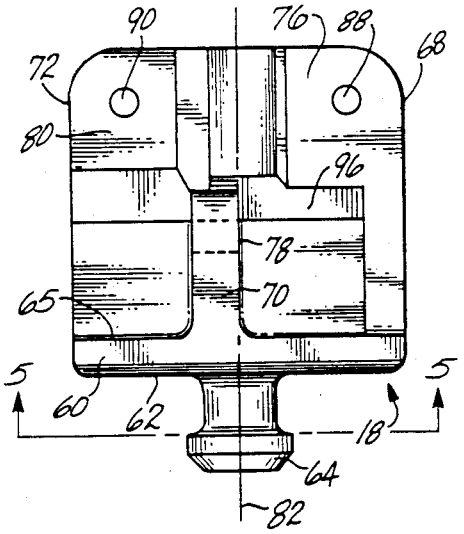
FIG. 3 is a top plan view of a frame hub.
Figure 4:
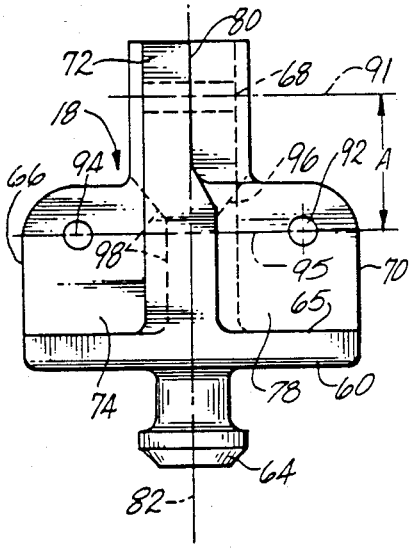
FIG. 4 is a side elevational view of the frame hub.
Figure 16:
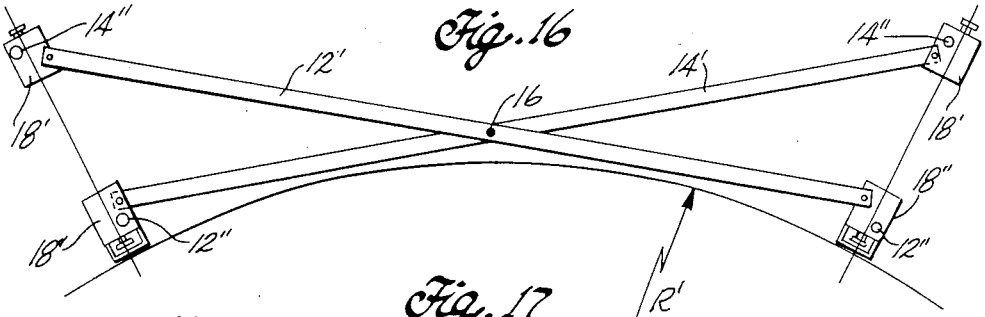
FIG. 16 is a semi-schematic plan view illustrating an alternative configuration of an expanded frame but using the hub design of FIGS. 3 through 5.

To use the hub shown in FIGS. 3 through 5 for a short radius configuration (keeping the same tube lengths so that the frame will fold and be of uniform height), the horizontal rods can be attached to the short flanges of the hub, as shown in FIG. 15. The front vertical portions of the frame section can be folded inwardly to form a shorter radius, but the horizontal cross frame tubes at the front of the display frame section begin to interfere with the curved display panel at a radius of approximately 28 inches. On the other hand, if the connections of the frame members to the hub flanges are reversed, as shown in FIG. 16, a curved display frame panel with a radius R' of 28 inches can easily be used without interference from the horizontal frame members. In the embodiment of FIG. 16, the frame members are reversed (from FIG. 15) by attaching the horizontal frame members to the long or "high" flanges of the hubs shown in FIGS. 3 through 5, and by attaching the vertical frame members to the short or "low" flanges of these hubs.

Thus, by rotating the hubs of FIGS. 3 through 5 and by reversing the attachment points of the horizontal and vertical frame members, the expanded display frame can be adapted to a wide range of radii so that display panels of various curvatures can be used in combination to produce different display panel designs. It should be noted that, in the example of FIG. 15, the vertical tubes are shorter than the horizontal tubes by two times the offset in the hub; while in the embodiment of FIG. 16, the horizontal tubes are shorter than the vertical tubes by two times the offset in the hub. Moreover, to keep the height of the overall frame uniform, the vertical cross members are made to the desired height and the correct length for their position on the hub, and then the horizontal cross members are made shorter, or longer, by two times the offset so that the frame will fold correctly.

Figure 17:
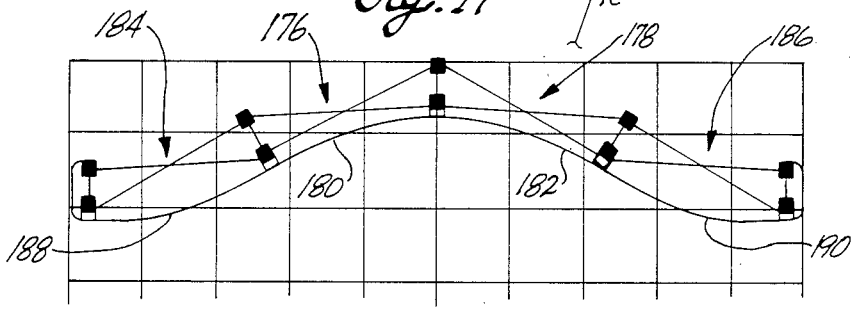
FIG. 17 is a semi-schematic plan view illustrating a further alternative configuration of an expanded frame, using the hub design of FIGS. 3 through 5 but in a different arrangement of hub positions and frame member connections.

As noted previously, when the horizontal cross frame members are attached to the long hub flanges and the vertical cross frame members are attached to the shorter hub flanges, the horizontal frame members must be shorter in length for the frame to fold. As a result, the display panels can be made narrower and used to form an alternative display frame design shown in FIG. 17 which can also fit within the standard ten-foot wide booth size. The illustration in FIG. 17 is a semi-schematic top plan view of a display booth area with a standard width of ten feet. Each square represents one square foot of floor space. In this embodiment the modified display frame has two side-by-side frame sections 176 and 178 in the middle of the display for supporting display panels 180 and 182 of concave curvature, and two outer frame sections 184 and 186 at the opposite ends of the display for forming convexly curved and narrower display panels 188 and 190. In the embodiment of FIG. 17, all horizontal cross frame members are attached to the long flanges of the hubs of FIGS. 3 through 5, while the vertical cross frame members are attached to the short flanges of the same hubs. By using the display frame configuration shown in FIG. 16 for each frame section in the FIG. 17 display, the resulting concave-convex display frame can fit within the standard ten-foot wide booth space. On the other hand, if the display frame assembly of FIG. 15 is used for each frame section, the resulting concave-convex display frame is too long and does not fit within the standard booth space.

Figure 18:
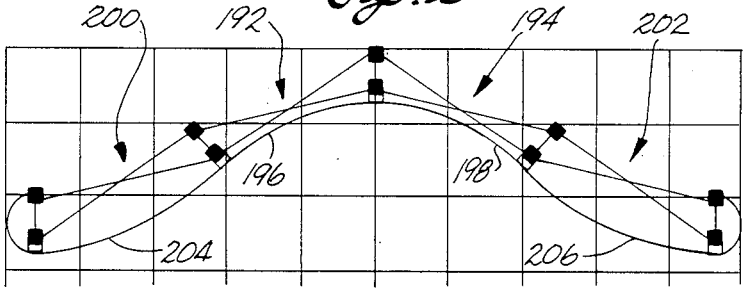
FIG. 18 is a semi-schematic plan view illustrating an alternative configuration of a display frame using the hub design of FIGS. 12 through 14.

FIG. 18 is a semi-schematic top plan view of a display booth area showing an alternative display frame design using the modified display frame hubs shown in FIGS. 12 through 14. In this example, the display frame has two side-by-side frame sections 192 and 194 in the middle of the display for supporting convexly curved display panels 196 and 198, and two outer frame sections 200 and 202 for supporting respective convexly curved display panels 204 and 206. In this embodiment, the vertical cross frame members are attached to the short flanges 134 and 136 of the modified hubs, and the horizontal cross frame members are attached to the pivot points in the holes 160 at the second plane 162 located the distance "2X" from the plane in which the vertical frame members are attached. In the resulting display frame, a much more angular configuration can be produced in which the centralmost display panels 196 and 198 have a much shorter curvature, and in which the outermost display panels 204 and 206 are wider but still have a narrower overall width than the standard display panel width.

Figure 19:
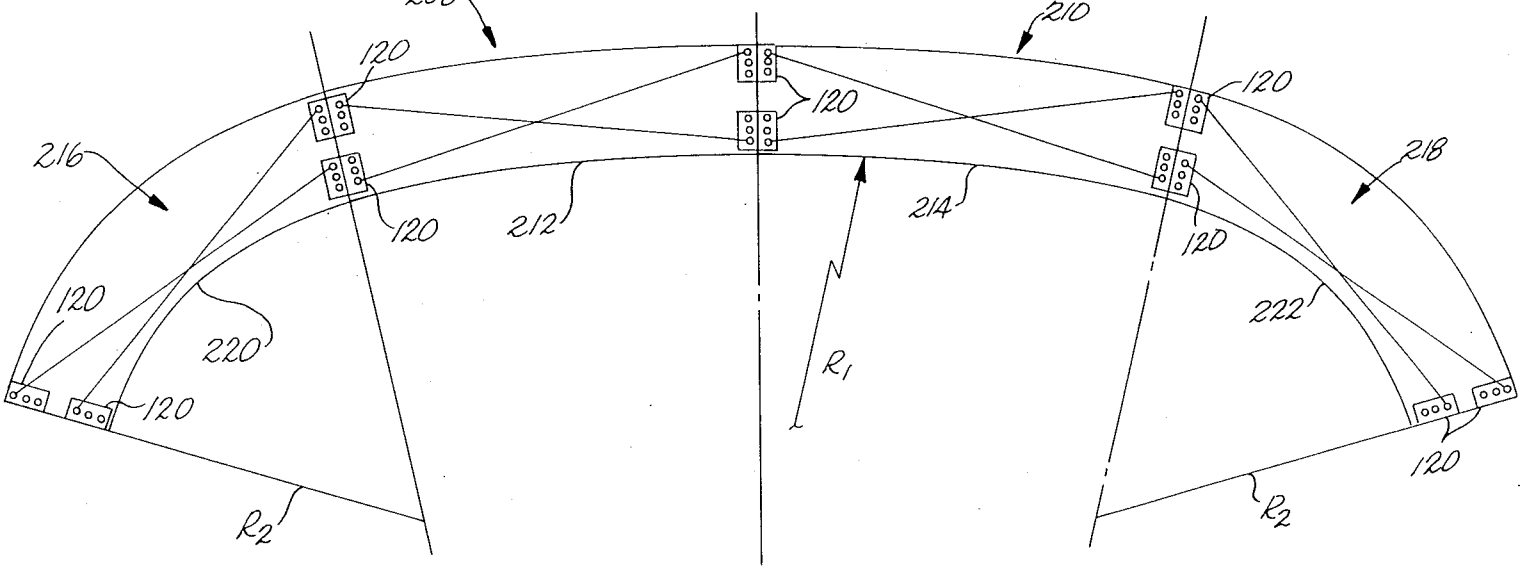
FIG. 19 is a semi-schematic plan view illustrating a further alternative display stand configuration using the hub design of FIGS. 12 through 14.

FIG. 19 shows a further display frame configuration which is made possible by the "high" and "low" flange display frame hub of this invention. In this embodiment, the display frame includes two side-by-side frame sections 208 and 210 in the middle of the display for supporting a pair of display panels 212 and 214 having a shallow curvature. The curvature of the panels can have a long radius of $R_1$ of 136 inches, i.e., approximately twice the standard display frame radius. The display frame shown in FIG. 19 further includes a pair of outer frame sections 216 and 218 arranged to support a pair of concavely curved outer display panels 220 and 222 with a short radius of curvature $R_2$. The inner frame sections 208 and 210 and the outer frame sections 216 and 218 each use the modified hub shown in FIGS. 12 through 14. In the illustrated embodiment, the pivot points closest to the base plate 122 of the hub 120 are used for attaching the horizontal rods located in the central portion of the frame. The horizontal rods for the outermost frame sections ar attached to the holes 164 lying in the third plane 166 near the outer ends of the long flanges. This attachment of the horizontal frame members to this extended position on the long hubs produces the extreme curvature of the outer frame sections. Moreover, the horizontal cross members on the end sections 216 and 218 are approximately two inches shorter than the horizontal cross members in the center frame sections 208 and 210. However, the frame still folds because of the offset in the hub.

Figure 20:
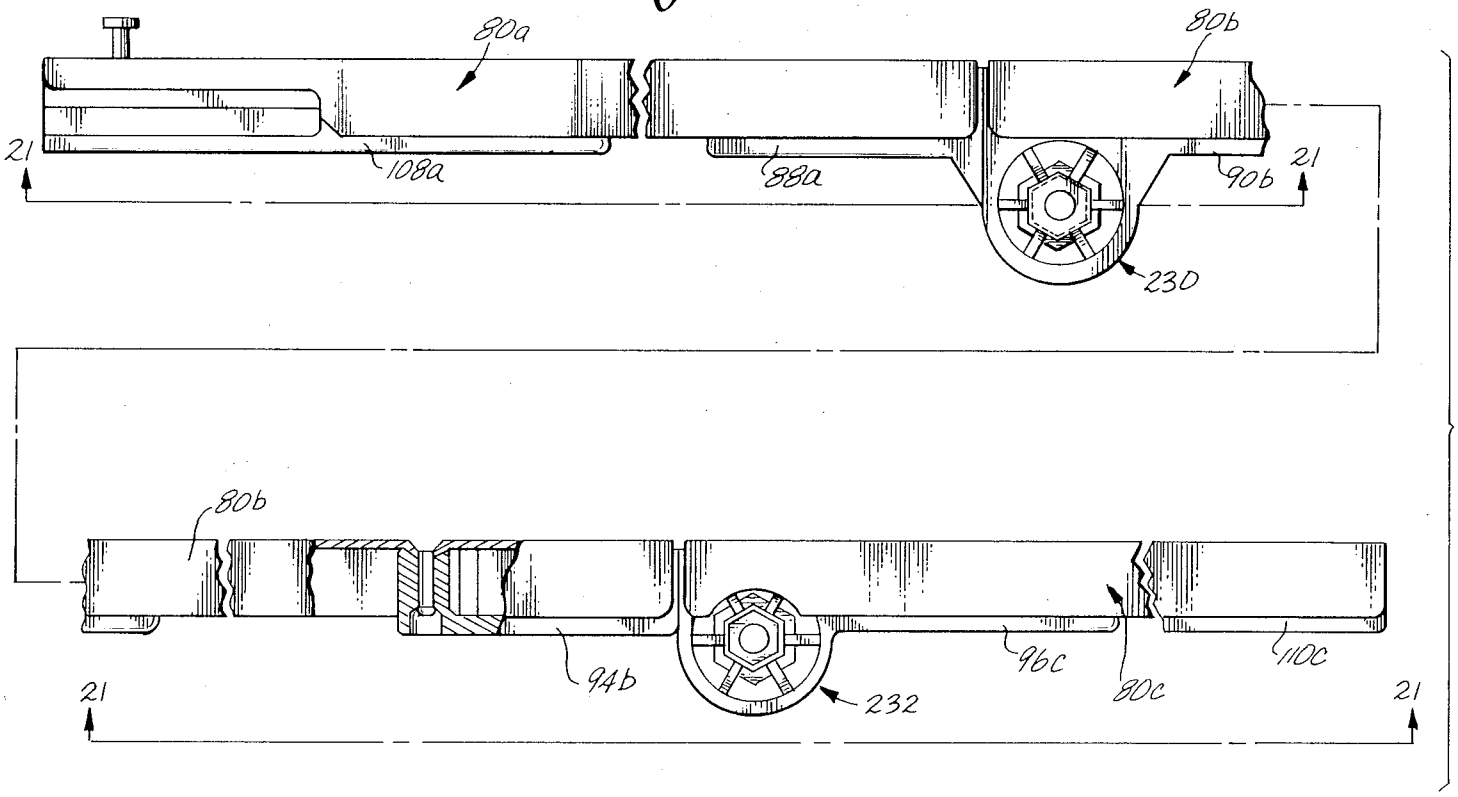
FIG. 20 is a fragmentary top plan view, partly in cross-section, showing an alternative embodiment of a folding channel bar.
Figure 21:
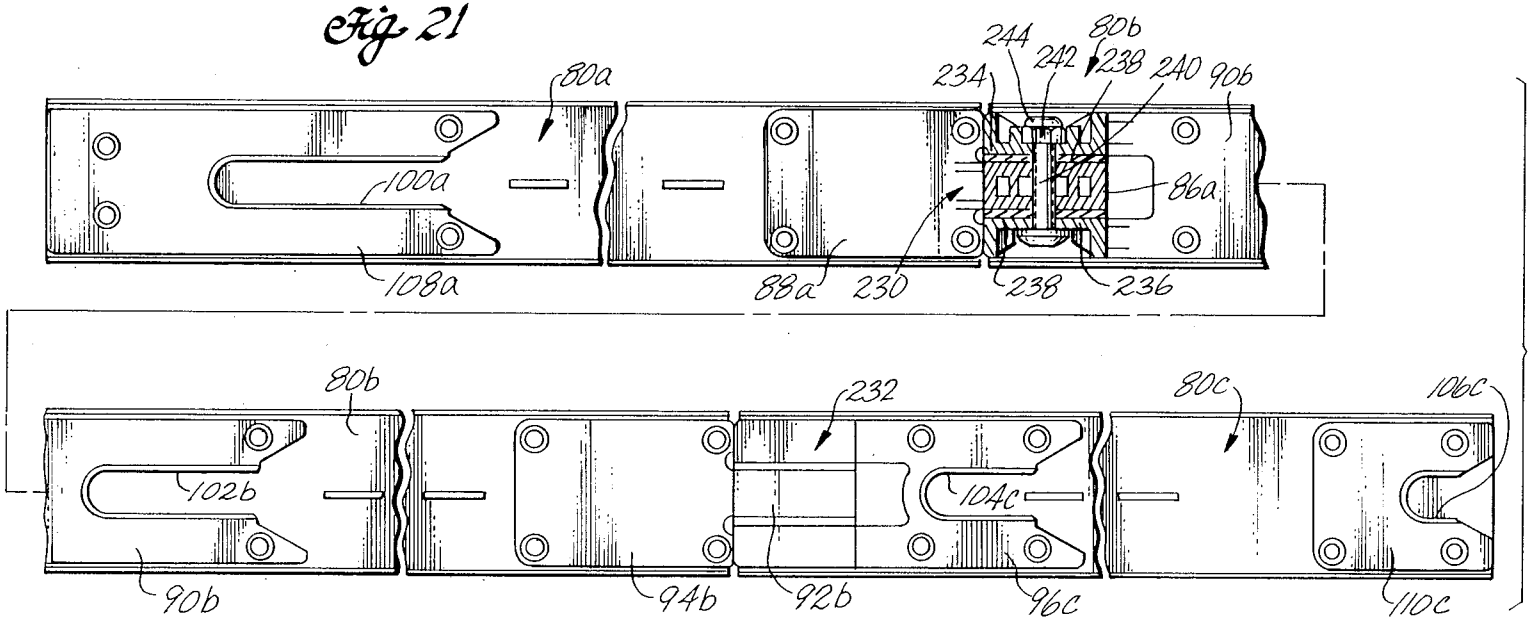
FIG. 21 is a fragmentary front elevational view, partly in cross-section, taken on line 21—21 of FIG. 20.
Figure 22:
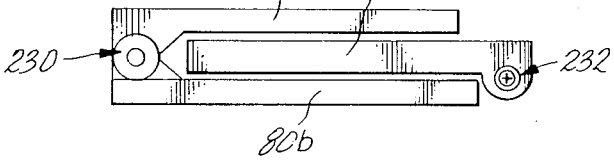
FIG. 22 is a detailed top plan view illustrating the folding channel bar in its folded configuration.

FIGS. 20 through 22 illustrate an alternative embodiment of the channel bar shown in FIGS. 10 and 11. In the embodiment shown in FIGS. 20 through 22, the channel bar has three sections: 80*a*, 80*b*, and 80*c*. The channel bar sections 80*a* and 80*b* are joined by a first hinged friction joint 230, and the channel bar sections 80*b* and 80*c* are joined by a second hinged friction joint 232. The two hinged friction joints are essentially identical in construction and the first hinged joint is illustrated best in the vertical cross-sectional view shown in FIG. 21. The first channel bar section 80*a* has a keyslot 100 a formed in a block 108*a* rigidly affixed to an end of the channel bar section 80*a*, and the third channel bar section 80*c* has an elongated keyslot 106*c* formed in a block 110*c* rigidly affixed to an end of the third channel bar section 80*c*. Case slots 102*b* and 104*c* also are formed in the first and second hinged friction joints 230 and 232, respectively.

The first hinged friction joint 230 includes an integrally formed center extension 86*a* of hinged member 88*a* secured to the first channel bar section 80*a* and joined to a hinged member 90*b* secured to an end of the second channel bar section 80*b*. Similarly, the second hinged friction joint 232 includes an integrally formed center extension 92*b* of hinged member 94*b* secured to the second channel bar section 80*b* and joined to a hinged member 96*c*, secured to an end of the third channel bar section 80*c*. The keyslot 102*b* is formed in the hinged member 90*b* of the first hinged friction joint 230, and the keyslot 104*c* is formed in the hinged member 96*c* of the second hinged friction joint 232. The extensions 86*a* and 92*b* and their respective hinged friction joints 230 and 232 allow the channel bar sections to be folded in a manner similar to the channel bar shown in FIGS. 10 and 11. FIG. 22 illustrates the channel bar in its folded configuration, folded about the first and second hinged friction joints 230 and 232.

Detailed construction of each hinged friction joint is best understood by referring to the cross-sectional view of FIG. 21 which shows the first hinged friction joint 230 in which the extension 86*a* is sandwiched between a protruding upper hinge plate 234 and a protruding lower hinge plate 236, both of which are integrally formed with the hinged block 90*b*. Compressible friction washers 238 are disposed between the upper and lower hinge plates and the top and bottom of the extension 86*a*. A bolt 240 extends vertically along the hinge pivot axis through the upper and lower hinge plates and the extension 86*a*. An adjustable nut 242 is threaded onto the end of the bolt, and a nylon insert 244 covers the shank portion of the bolt. The second hinged friction joint 232 is constructed in a similar manner except that the first hinged friction joint 230 protrudes farther from the face of the channel bars than the second hinged friction joint 232, as shown best in FIG. 20. This arrangement permits for folding of the channel bar as shown in FIG. 22.

During use, it can be important to prevent unrestrained folding of one channel bar section relative to an adjacent channel bar section. By tightening the bolt against the friction washers, a controlled amount of rotational friction is produced at each hinged joint, which can be an advantage to the user when assembling the keyslots of the channel bars to the vertical columns of the expanded frame. The components of each hinged friction joint are of sturdier construction than the hinged joint members in the embodiment of FIGS. 10 and 11 which improves wear life of the channel bars.

From the above description it will be recognized that the improved display framework has been provided which can be made very compact and light in weight, while retaining overall strength, rigidity, and stability of the display stand. The framework also provides a means for assembling the display in a number of useful configurations, and in each embodiment the frame can be quickly and easily opened up for use and collapsed for storage.

What is claimed is:

1. A folding framework for use as a folding display frame movable between an open expanded position forming a three-dimensional array of cubicles in a display-supporting frame and a compact closed form for storage, the framework comprising:

a plurality of pairs of rods, each pair of rods being pivotally joined to each other at an intermediate point;

a plurality of hubs, the respective ends of each rod being pivotally joined to corresponding ones of said hubs, each hub having a plurality of said rods pivotally joined thereto;

the pivotal connection of each rod to a hub providing rotation of the rod relative to the hub about a corresponding single axis of revolution;

rods connected to any one hub being rotatable about said single axis of revolution from a closed position in which all the rods are substantially parallel to each other to an open position in which the rods radiate outwardly from each other;

each hub having a base plate with fixed flanges projecting therefrom for pivotally supporting a first pair of said rods secured to a corresponding first pair of said flanges on opposite sides of a central axis of the hub and a second pair of said rods pivotally connected to a corresponding second pair of said flanges on opposite sides of the central axis of the hub, said second flanges extending substantially perpendicularly to said first flanges;

the pair of first flanges having corresponding fixed first bearing surfaces lying substantially on a first axis passing essentially through the central axis of the hub, the pair of second flanges having corresponding fixed second bearing surfaces lying substantially on a second axis passing essentially through the central axis of the hub and extending substantially perpendicularly to said first axis;

the ends of the first rods pivotally secured to said first bearing surfaces being rotatable thereon about spaced apart fixed axes of revolution extending substantially parallel to each other and lying substantially in a first plane, the ends of the second rods pivotally secured to said second bearing surfaces being rotatable thereon about spaced apart fixed axes of revolution extending substantially parallel to each other and lying substantially in a second plane which is spaced outwardly from the base plate by an offset distance greater than said first plane and which lies substantially parallel to the first plane.

2. Apparatus of claim 1 wherein all the rods are of substantially equal length and each rod is connected at one end at a pivotal connection in said first plane of the associated hub and is connected at the other end at a pivotal connection in said second plane of the associated hub.

3. Apparatus of claim 1 wherein the rods are of a first length or a second length, the difference in length being twice the distance between said first and second planes.

4. Apparatus of claim 1 wherein, in said open position, the rods connected to each hub extend outwardly substantially perpendicularly to each other, whereby the rods and associated hubs form a rectangular lattice.

5. Apparatus of claim 2 wherein, in said open position, the rods connected to each hub extend outwardly substantially perpendicularly to each other, whereby the rods and associated hubs form a substantially square shaped lattice.

6. Apparatus of claim 3 wherein, in said open position, the rods connected to each hub extend outwardly substantially perpendicularly to each other, whereby the rods and associated hubs form a rectangularly shaped lattice.

7. Apparatus of claim 1 further including stab connector means mounted on at least one pair of hubs, the stab connector means including a male member rigidly mounted on and projecting from one of said pair of hubs, and a female member rigidly mounted on and projecting from the other of said pair of hubs, the male and female members telescopically engaging when the hubs are moved into the open position of the folding frame, and a releasable catch on one of said members engaging the other of said members to lock the telescopically engaged members together.

8. Apparatus of claim 1 in which the rods are tubular metal rods with an outside diameter approximately one half the width of the hub.

9. Apparatus of claim 1 in which the second pair of flanges project outwardly from the base plate of the hub by an extended distance in which the second plane is at least twice the distance from the base plate than the first plane, whereby the framework can be moved to an open position defining a short radius of curvature.

10. Apparatus of claim 9 in which the pair of second flanges includes multiple pivot points to which the second rods can be selectively attached on each second flange, said pivot points on each flange comprising spaced apart holes on each second flange progressing outwardly from the base plate.

11. Apparatus of claim 1 wherein the spacing between the first and second flanges allows each base plate to be sufficiently compact in size while its folded rods avoid interference with each other sufficiently so that the hubs can nest against each other in the closed condition of the framework.

12. Apparatus of claim 1 wherein the rods pivotally attached to the first flanges of each hub are longer than the rods pivotally attached to the second flanges of each hub, to thereby form a rectangular lattice.

13. Apparatus of claim 1 wherein the rods pivotally attached to the first flanges of a first hub are pivotally secured at their opposite ends to corresponding second flanges of a second hub, and in which the rods pivotally attached to the second flanges of a first hub are pivotally secured at their opposite ends to corresponding first flanges of said second hub, to thereby form a substantially square shaped lattice in the open condition of the framework.

14. Apparatus of claim 1 in which the first flanges are offset from one another on opposite sides of the central axis, and the second flanges are offset from one another on opposite sides of the central axis.

15. In a folding open framework for use as a folding display frame movable between an open expanded position forming a three-dimensional array of cubicles in a display-supporting frame and a compact closed form for storage, the framework comprising a plurality of pivotally joined pairs of rod members in which four of said pairs of rod members are pivotally joined at their ends by eight hub members to form four sides of a rectangular cubicle having a hub at each of the eight corners of the cubicle, a plurality of said cubicles forming an array with adjoining cubicles sharing a common pair of rod members and the associated four hub members at each of the ends of the pair of rod members, the improvement comprising:

each hub member having a base plate with fixed flanges projecting therefrom for supporting a first pair of said rod members pivotally secured to a corresponding first pair of flanges on opposite sides of a central axis of the hub and a second pair of said rod members pivotally secured to a corresponding second pair of said flanges on opposite sides of the central axis of the hub, said second flanges extending substantially perpendicularly to said first flanges;

the pair of first flanges having corresponding fixed first bearing surfaces lying substantially on a first axis passing essentially through the central axis of the hub, the pair of second flanges having corresponding fixed second bearing surfaces lying substantially on a second axis passing essentially through the central axis of the hub and extending substantially perpendicularly to the first axis;

the ends of the first rod members pivotally secured to the first bearing surfaces being rotatable thereon about spaced apart fixed axes of revolution extending substantially parallel to each other and lying substantially in a first plane, the ends of the second rod members pivotally secured to said second bearing surfaces being rotatable thereon about spaced apart fixed axes of revolution extending substantially parallel to each other and lying substantially in a second plane which is spaced outwardly from the base plate by an offset distance greater than said first plane and which lies substantially parallel to said first plane.

16. Apparatus of claim 15 wherein the rod members pivotally attached to the first of said hub flanges are longer than the rod members pivotally attached to the second of said hub flanges, the difference in length being equal to twice the amount of offset of the associated axes of revolution.

17. The apparatus of claim 15 wherein the rod members are all of substantially equal length.

18. Apparatus of claim 15 further including stab connector means mounted on at least one pair of hubs, the stab connector means including a male member rigidly mounted on and projecting from one of said pair of hubs and a female member rigidly mounted on and projecting from the other of said pair of hubs, the male and female members telescopically engaging when the hubs are moved into the open position of the folding frame, and a releasable catch on one of said members engaging the other of said members to lock the telescopically engaged members together.

19. Apparatus of claim 15 wherein the hubs on at least one side of the framework include a flanged knob projecting therefrom, a bar having a plurality of keyslots spaced along the bar at intervals corresponding to the distance between knobs, for engaging the knobs of aligned hubs, whereby the bar is removably secured to a plurality of hubs, each successive keyslot being shorter in length than the adjacent keyslot, whereby the bar can be engaged one knob at a time to the aligned hubs.

20. Apparatus of claim 19 wherein the bar includes a plurality of sections and hinge means securing each section to an adjacent section, whereby the bar can be folded when not secured to the knobs.

21. Apparatus according to claim 20 in which the hinge means have adjustable friction means for controllably adjusting the friction of the hinge joint about with the sections of the bar fold.

22. Apparatus of claim 15 in which the spacing between the first and second flanges allows each base plate to be sufficiently compact in size while its folded rod members avoid interference with each other sufficiently so that the hubs can nest against each other in the closed condition of the framework.

23. Apparatus of claim 15 wherein the rod members pivotally attached to the first flanges of each hub are longer than the rod members pivotally attached to the second flanges of each hub to form a rectangular lattice.

24. Apparatus of claim 15 wherein the rod members pivotally attached to the first flanges of a first hub are pivotally secured at their opposite ends to corresponding second flanges of a second hub, and in the rods pivotally attached to the second flanges of a first hub are pivotally secured at their opposite ends to corresponding first flanges of said second hub to form a substantially square shaped lattice in the open configuration of the framework.

25. Apparatus of claim 15 in which the first flanges are offset from one another on opposite sides of the central axis, and the second flanges are offset from one another on opposite sides of the central axis.

26. Apparatus of claim 15 in which the rods are tubular metal rods with an outside diameter approximately one half the width of the hub.

27. Apparatus of claim 15 in which the second pair of flanges project outwardly from the base plate of the hub by an extended distance in which the second plane is at least twice the distance from the base plate than the first plane, whereby the framework can be moved to an open position defining a short radius of curvature.

28. Apparatus of claim 27 in which a pair of second flanges includes multiple pivot points to which the second rods can be selectively attached on each second flange, said pivot points on each flange comprising spaced apart holes on each second flange progressing outwardly from the base plate.

29. A folding framework for use as a folding display frame movable between an open expanded position forming a three-dimensional array of compartments in a display-supporting frame and a compact closed form for storage, the framework comprising:

a plurality of pairs of rods, each pair of rods being pivotally joined to each other at an intermediate point;

a plurality of hubs, the respective ends of each rod being pivotally joined to corresponding ones of said hubs, each hub having a plurality of said rods pivotally joined thereto;

the pivotal connection of each rod to a hub providing rotation of the rod relative to the hub about a corresponding single axis of revolution;

rods connected to any one hub being rotatable about said single axis of revolution from a closed position in which all the rods are substantially parallel to each other to an open position in which the rods radiate outwardly from each other;

each hub having a base plate with fixed flanges projecting therefrom for pivotally supporting a first pair of said rods secured to a corresponding first pair of said flanges on opposite sides of a central axis of the hub and a second pair of said rods pivotally connected to a corresponding second pair of said flanges on opposite sides of the central axis of the hub, said second flanges extending at an angle to said first flanges;

the pair of first flanges having corresponding fixed first bearing surfaces lying substantially on a first axis passing essentially through the central axis of the hub, the pair of second flanges having corresponding fixed second bearing surfaces lying substantially on a second axis passing essentially through the central axis of the hub and extending at said angle to said first axis;

the ends of the first rods pivotally secured to said first bearing surfaces being rotatable thereon about spaced apart fixed axes of revolution extending substantially parallel to each other and lying substantially in a first plane, the ends of the second rods pivotally secured to said second bearing surfaces being rotatable thereon about spaced apart fixed axes of revolution extending substantially parallel to each other and lying substantially in a second plane which is spaced outwardly from the base plate by an offset distance greater than said first plane and which lies substantially parallel to the first plane.

30. Apparatus of claim 29 in which the second pair of flanges project outwardly from the base plate of the hub by an extended distance in which the second plane is at least twice the distance from the base plate than the first plane, whereby the framework can be moved to an open position defining a short radius of curvature.

31. Apparatus of claim 30 in which the pair of second flanges includes multiple pivot points to which the second rods can be selectively attached on each second flange, said pivot points on each flange comprising spaced apart holes on each second flange progressing outwardly from the base plate.

32. Apparatus of claim 29 wherein the hubs on at least one side of the framework include a flanged knob projecting therefrom, a bar having a plurality of keyslots spaced along the bar at intervals corresponding to the distance between knobs, for engaging the knobs of aligned hubs, whereby the bar is removably secured to a plurality of hubs, each successive keyslot being shorter in length than the adjacent keyslot, whereby the bar can be engaged one knob at a time to the aligned hubs.

33. Apparatus of claim 32 wherein the bar includes a plurality of sections and hinge means securing each section to an adjacent section, whereby the bar can be folded when not secured to the knobs.

34. Apparatus according to claim 33 in which the hinge means have adjustable friction means for controllably adjusting the friction of the hinge joint about with the sections of the bar fold.

* * * * *